United States Patent [19]

Roth et al.

[11] 4,388,507

[45] Jun. 14, 1983

[54] EXCESS-CURRENT PROTECTIVE SWITCH

[75] Inventors: Adrian W. Roth, Aarau; Tibor Morva, Oberentfelden, both of Switzerland

[73] Assignee: Sprecher & Schuh AG, Aarau, Switzerland

[21] Appl. No.: 306,153

[22] Filed: Sep. 28, 1981

[30] Foreign Application Priority Data

Oct. 17, 1980 [CH] Switzerland ..... 7766/80

[51] Int. Cl.[3] ..... H01H 33/70

[52] U.S. Cl. ..... 200/148 R; 335/174

[58] Field of Search ..... 200/148 R, 148 A, 148 B, 200/148 C, 148 D, 148 E, 148 F, 148 G, 148 H, 148 J, 148 BV; 335/21, 22, 23, 174, 170, 16

[56] References Cited

U.S. PATENT DOCUMENTS 2,757,261 7/1956 Lingal et al. ..... 361/14 X
3,002,073 9/1961 Cobine ..... 200/148 R X
3,263,042 7/1966 Dyer et al. ..... 335/16 X

*Primary Examiner*—A. T. Grimley
*Assistant Examiner*—Morris Ginsburg
*Attorney, Agent, or Firm*—Werner W. Kleeman

[57] ABSTRACT

In the cut-on position of the protective switch a movable contact element engages with a stationary contact element and at the same time is exposed to the action of a force displacing such movable contact element into a cut-off position. The movable contact element is arrestable in the cut-on position by means of a locking device which can be activated by an excess current. In order to reduce the number of movable parts to a minimum as well as to avoid parts which generate heat due to appreciable thermal losses, such locking device is provided with a substantially U-shaped locking element formed of a soft magnetic material. This locking element surrounds the movable contact element with play or clearance and is displaceably mounted transversely with respect to the flow of current in such movable contact element. At least one free leg end of the locking element is provided with a stop which in the cut-on position cooperates with a stop nose which is movable together with the movable contact element. The protective switch is suitable for installation in medium voltage and high-voltage switching installations.

13 Claims, 5 Drawing Figures

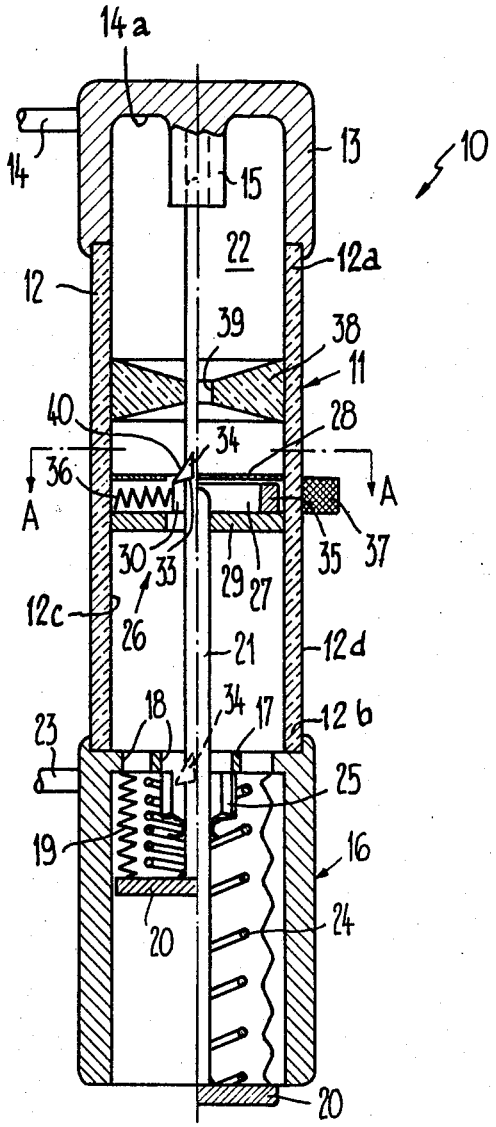
Fig. 1
Fig. 2
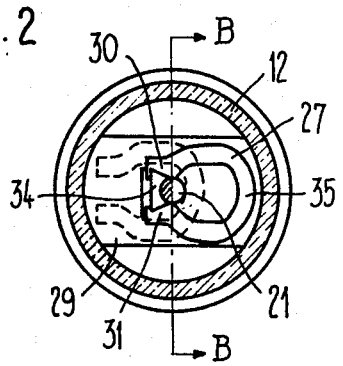
Fig. 3
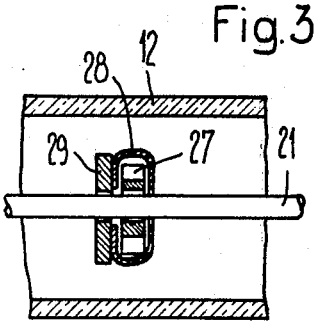

EXCESS-CURRENT PROTECTIVE SWITCH

BACKGROUND OF THE INVENTION

The present invention relates to a new and improved excess-current protective switch.

Generally speaking, the inventive protective switch is of the type comprising a movable contact element which in the cut-on position is in engagement with a stationary contact element and is exposed to the action of a force displacing such contact element into a cut-off position. A locking device or mechanism is provided which can be released in the presence of an excess current and by means of which the movable contact element can be arrested or locked in the cut-on position.

Such excess-current protective switches are often employed instead of fuses, which only can be used once. They are installed in electrical switching installations working with medium and high voltages for protecting the same for instance against short-circuit or fault currents.

A known protective switch of the initially mentioned type is disclosed in U.S. Pat. No. 2,757,261 in conjunction with FIGS. 8 and 10, which correspond to FIGS. 4 and 5 of German Patent Application No. W 8851 VIII b/21c, published Sept. 6, 1956.

With prior art excess-current protective switches the spring-loaded, movable contact element is coupled with the locking device by means of a lever drive. The locking device, in turn, is provided with a pawl mechanism which is operatively associated with an electromagnet. Such electromagnet is provided with a movable armature cooperating with the pawl mechanism. The excitation or field coil of the movable armature consists of a few turns of a conductor connected in series with the movable contact element. If an excess current, for instance a short-circuit current flows through the conductor, the attraction force of the electromagnet upon the movable armature is sufficient to cause the armature to unlock the pawl mechanism. Thereafter the movable contact element is free to move under the action of the spring and to advance into the cut-off position.

The heretofore known protective switch has the disadvantage of containing numerous mechanically movable parts or elements and also numerous pivot pins, which is particularly unfavorable for switches of this type since, in the long run, such construction impairs the reliability of the protective switch. Moreover, such design is in direct opposition to the object of manufacturing such protective switches as simply and therefore as cheaply as possible, but without any loss in functional reliability.

Finally, with the state-of-the-art switch the excitation coil of the magnet, which always carries current in the cut-on position of the switch, continuously generates heat due to thermal losses which has to be dissipated. This heat dissipation can be accomplished by direct cooling measures or, as with the previously known switch, by arranging the elements of the switch in a relatively large internal chamber which allows for a sufficient circulation of the medium contained therein in order to obtain the required cooling effect.

SUMMARY OF THE INVENTION

Thus, it is an important object of the present invention to provide an improved construction of excess-current protective switch which is not afflicted with the aforementioned drawbacks and shortcomings of the prior art constructions discussed above.

Another important object of the present invention is to provide an improved construction of protective switch of the initially mentioned type which is not associated with the limitations and drawbacks of the prior art switch constructions and is designed so as to contain a minimum number of movable components and requires a minimum amount of space, while being exceedingly reliable in operation and not requiring any coils through which a current flows.

Now, in order to implement these objects and others, which will become more readily apparent as the description proceeds, the excess-current protective switch according to the invention contemplates utilizing as the locking device or mechanism a substantially U-shaped locking element which is formed of a soft magnetic material and surrounds the movable contact element with play or clearance. The locking element is displaceably mounted for movement transversely with respect to the flow of current through the movable contact element. At least one free leg end of such locking element is provided with a stop or impact member which, in the cut-on position of the switch, cooperates with a stop or impact nose or equivalent structure which is movable in conjunction with the movable contact element.

BRIEF DESCRIPTION OF THE DRAWINGS

The invention will be better understood and objects other than those set forth above will become apparent when consideration is given to the following detailed description thereof. Such description makes reference to the annexed drawings which illustrate a number of exemplary embodiments of the inventive excess-current protective switch and wherein:

FIG. 1 is a simplified axial sectional view of an excess-current protective switch, the left-hand side of the drawing showing the cut-on position and the right-hand side showing the cut-off position thereof;

FIG. 2 is a simplified sectional view taken substantially along the line A—A of FIG. 1, while omitting certain parts or elements in order to preserve clarity in the illustration;

FIG. 3 is a sectional view taken substantially along the line B—B of FIG. 2;

DETAILED DESCRIPTION OF THE PREFERRED EMBODIMENTS

Figure 4:
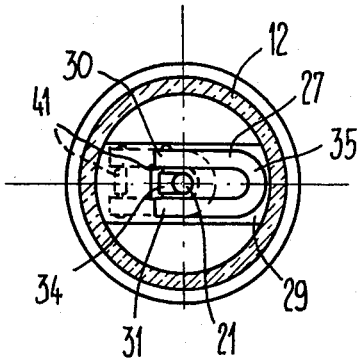
FIG. 4 is a sectional view analogous to FIG. 2 and depicting a modified embodiment of excess-current protective switch.

Describing now the drawings, the illustrated exemplary embodiment of excess-current protective switch shown in FIGS. 1 to 3 will be seen to comprise a switch housing 11 provided with an insulating tube or pipe 12, the upper end **12*a* of which is sealed by a cap or closure member 13. A first connection line 14 leads away from the cap or closure member 13 which at its internal side or inner surface 14*a* carries a merely schematically indicated stationary contact element 15. The lower end 12*b* of the insulating tube or pipe 12 is sealed by a closure element 16 which is substantially shaped like a downwardly open pot or cup. A second connection line 23 leads from this pot or cup-shaped closure element 16. The front end or face 17 of the closure element 16** is connected with the insulating tube or pipe 12 and contains continuous bores 18, wherein the central or intermediate bore serves for the throughpass of a movable contact element 21 as will be explained more fully hereinafter. At the side of the front end 17 of the closure element 16 which faces away from the insulating tube 12 there is sealingly attached a metallic bellows 19 which, in turn, is sealingly closed by an end or closure plate 20. At the side of such closure plate 30 which confronts the insulating tube 12 there is attached the substantially rod-shaped, movable contact element 21 which extends through the bellows 19 and the central bore 18.

Thus, the internal chamber or compartment 22 of the switch housing 11 is sealed in a completely gas-tight manner with respect to the surroundings. This internal chamber 22 can be filled with a suitable extinguishing gas, e.g. $SF_6$, which is at an excess pressure, and therefore, has a tendency to expand the bellows 19 downwards, i.e. to force the movable contact element 21 into the cut-off position.

Instead of the overpressure or excess pressure within the internal chamber or compartment 22, or in addition to the same, there can be provided within the expandible bellows or diaphragm 19 a pressure or compression spring 24 which is supported at one end by the end or closure plate 20 and at the other end by the front end or face 17 of the closure element 16.

At the side of the front end 17 which faces away from the insulating tube 12 there are arranged sliding contacts 25 which engage at the outside of the movable contact element 21. These sliding contacts 25 establish an electrical connection of the movable contact element 21, by means of the closure element 16, with the connection line 23.

Normally, the movable contact element 21 is locked in the cut-on position, indicated at the left-hand side of FIG. 1, by means of a locking device or mechanism, which is generally designated in its entirety by reference character 26. The movable contact element 21 is locked in this position against the action of the force resulting from the excess pressure in the internal chamber 22 and/or the force of the spring 24. For a more detailed description of such locking device or mechanism 26 reference is now made to FIGS. 2 and 3.

The locking device comprises a substantially U-shaped or, to be more precise, a substantially horseshoe shape locking element or bar 27 as shown in FIG. 2. This locking element 27 is formed of a soft magnetic material and surrounds the contact element 21 with play or clearance. Locking element 27 is displaceable transversely with respect to the flow of current through the movable contact element 21 and can be guided for such purpose by a protecting bearing sleeve 28, shown in FIG. 3, which is penetrated with clearance by the movable contact element 21. This bearing sleeve 28 or, if no bearing sleeve is provided, the locking element 27 is supported by a traverse or cross element 29 which bridges the internal chamber 22 and is secured at the inner surface or wall 12*c* of the insulating tube or pipe 12.

Figure 5:
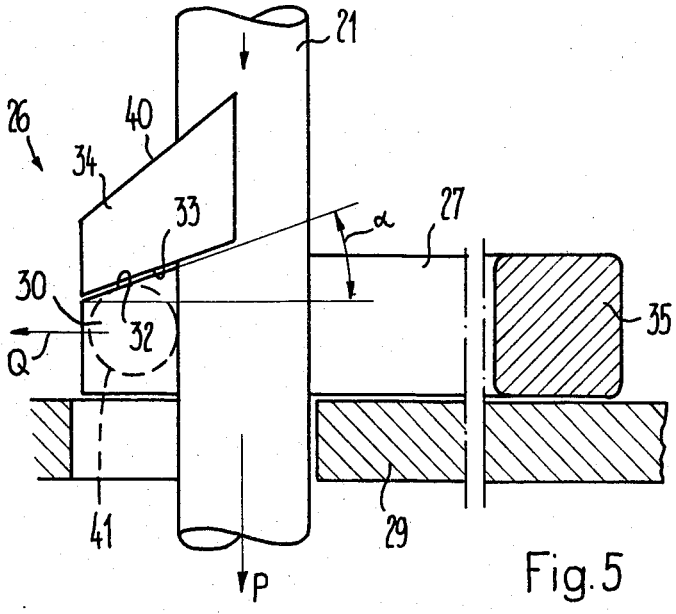
FIG. 5 is a simplified and enlarged view of details of the protective switch shown in FIG. 1.

Both free leg ends 30 and 31 of the locking element 27 are provided with impact or stop surfaces 32, but in FIG. 5 only the impact or stop surface 32 of leg end 30 is shown. Upon such impact or stop surface 32 there rests in the cut-on position of the switch the impact or stop surface 33 of a stop or impact nose 34 or equivalent structure which is formed or secured, as the case may be, to the movable contact element 21. In this position, the yoke or cross piece 35 of the locking element 27, i.e. the section of such locking element 27 which connects the two legs 30 and 31 is located further from the movable contact element 21 than the two free leg ends 30 and 31.

Now, when there is a current flow through the movable contact element 21, a magnetic field is generated around such contact element 21. This magnetic field is particularly pronounced in the magnetic circuit defined by the locking element 27. As a result, forces act upon the locking element 27 which have a tendency to displace the same with respect to the movable contact element 21, so that the magnetic resistance of the magnetic circuit is the lowest possible. Such magnetic resistance is lowest at the time when the movable contact element 21 is located close to the yoke 35. As long as the movable contact element 21 carries current the locking element 27 is thus always subject to forces which have a tendency to move such locking element 27 towards the left of FIGS. 1, 2 and 5. This is the position indicated by broken or phantom lines in FIG. 2. Hence, the free leg ends 30 and 31 release the stop nose or protuberance 34, and thus, the movable contact element 21 which can now perform the switching-off or cut-off stroke. However, such forces are initially counteracted by the pressure which is exerted by the stop nose 34 upon the locking element 27 and, respectively, by the frictional contact which is created between the locking element 27 and the bearing sleeve 28 or, respectively, the traverse 29. Furthermore, an inclination $\alpha$ can be provided for the impact or stop surfaces 32 and 33 at the free leg ends 31 and 32 and, at the stop nose 34 or the like, as best seen by referring to FIG. 5. This inclination $\alpha$ in conjunction with the force P which acts upon the movable contact element 21 in the switching-off or cut-off direction, produces a resultant force which counteracts the force Q emanating from the magnetic field and acting upon the locking element 27. However, the force Q is a function of the current which flows through the movable contact element 21, whereas the forces which counteract Q are almost constant. Thus, the response threshold of the excess current-protective switch can be determined, for instance, by correspondingly selecting the inclination $\alpha$.

Alternatively, or preferably additionally, means can be provided which exert a restoring or return force upon the locking element 27, i.e. a force which acts towards the right of the drawings of FIGS. 1, 2 and 5. Such means can be constituted by a pressure or compression spring 36, which only has been illustrated in FIG. 1, and/or a permanent magnet 37 which is attached at the outside or outer surface 12*d* of the insulating tube 12 at the level of the locking element 27 or which can be advanced to such position when necessary.

If the current-dependent force Q overcomes the nearly constant forces which counteract the same, than the locking element 27 is displaced into the position which is indicated by broken or phantom lines in FIG. 2. Consequently, the impact or stop surface 32 and 33 disengage and release the stop nose 34 and, in turn, the movable contact element 21 is released for performing a switching-off or cut-off stroke. As a result, the volume of the internal chamber 22 is enlarged as a result of the dilatation or expansion of the bellows 19. In order to use the resulting pressure reduction for extinguishing the switching arc there is arranged between the locking device 26 and the stationary contact element 15 a blast nozzle 38 within the insulating tube or pipe 12. This blast nozzle 38 is formed of a suitable insulating material and its central throughpass opening 39 remains practically closed by the movable contact element 21 as long as the free end thereof has not passed through the opening 39 during the course of a cut-off stroke. Thus, the internal pressure in the portion of the internal chamber or compartment 22 which is located between the blast nozzle 38 and the stationary contact element 15 remains almost constant at the beginning of a cut-off stroke. On the other hand, all the more there is reduced the internal pressure in the portion of the internal chamber 22 which is located between the blast nozzle 38 and the end or closure plate 20. The resulting pressure drop leads to a strong gas flow through the opening 39 as soon as the same has been freed by the movable contact element 21. This gas flow or current blows the arc and contributes to a reliable extinction thereof.

If the protective switch should be again switched-on, then the locking element 27 must be moved back into its original position. This can be accomplished by the action of the spring 36 and/or the magnet 37 as soon as the switching arc is extinguished, i.e. as soon as there has stopped the flow of the excess current. Through the exertion of force upon the closure plate 20 the bellows 19 is compressed, and thus, the movable contact element 21 is displaced towards the stationary contact element 15. A rejection or repulsion face 40 is arranged on the side of the stop nose 34 which is located opposite to the impact or stop surface 33. This rejection face or surface 40 then impinges upon the locking element 27 which is in its original position, and displaces the same temporarily until the stop nose 34 has again assumed a position between the stationary contact element 15 and the locking device 26. Now the locking element 27 can again return back into its original position, and thus, the movable contact element 21 is locked in the cut-on position of the protective switch.

In order to render the switch position of the illustrated protective switch 10 immediately visible from the outside, the side of the closure plate 20 which faces away from the bellows 19 can be provided with a conspicuous color or with any other suitable marking or the like.

The embodiment of protective switch shown in FIG. 4 differs from the embodiment of FIGS. 1 to 3 in that the locking element 27 possesses a purely U-shaped configuration. The free leg ends 30, 31 of the locking element 27 are interconnected with each other by means of a stop or impact element 41 which is formed of a non-magnetizable material. The stop or impact nose 34 bears against the impact element 41 in the cut-on position of the protective switch. This stop or impact element 41 can be formed by a rotatable roll or also can be substantially prism-shaped. As readily can be seen from FIG. 5, with the embodiment of FIG. 4 which has a stop or impact roll serving as a stop or impact element 41 the impact or stop surface 33 likewise can be given an inclination $\alpha$ with respect to the stop or impact nose 34. By means of such inclination $\alpha$ the force P which acts upon the movable contact element 21 generates a force which counteracts the force Q of the locking element 27. Also in this case the inclination $\alpha$ of the impact surface 33 is decisive for the response threshold of the protective switch.

While there are shown and described present preferred embodiments of the invention, it is to be distinctly understood that the invention is not limited thereto but may be embodied and practised within the scope of the following claims.

Accordingly, what we claim is:

1. An excess-current protective switch operative between a cut-on position and a cut-off position comprising:

a stationary contact element;

a movable contact element engageable with said stationary contact element in the cut-on position of the switch;

said movable contact element being displaceable between a cut-on position and a cut-off position;

said movable contact element being subjected to a force tending to displace the same into its cut-off position;

a locking device for locking said movable contact element in the cut-on position;

said locking device comprising a substantially U-shaped locking element formed of a soft magnetic material and surrounding said movable contact element with play;

means mounting said locking element for movement transversely with respect to the flow of current to said movable contact element;

said substantially U-shaped locking element having free leg ends;

stop means provided for at least one free leg end of said locking element;

a stop nose provided for and movable in conjunction with said movable contact element; and said stop means cooperating in the cut-on position with said stop nose.

2. The excess-current protective switch as defined in claim 1, wherein:

said locking element is substantially horseshoe-shaped and possesses two of said free leg ends; and said two free leg ends of said locking element being provided with stop surfaces.

3. The excess-current protective switch as defined in claim 1, wherein:

said stop means of said locking element comprises an impact element interconnecting the free leg ends of the locking element and being formed of a non-magnetizable material.

4. The excess-current protective switch as defined in claim 3, wherein:

said impact element comprises a freely rotatable impact roll.

5. The excess-current protective switch as defined in claim 1, further including:

means for displaceably mounting the locking element against the action of a restoring force.

6. The excess-current protective switch as defined in claim 5, wherein:

said stop nose contains a stop surface and opposite thereto a rejection surface.

7. The excess-current protective switch as defined in claim 5, further including:

a magnet for exerting said restoring force on said locking element.

8. The excess-current protective switch as defined in claim 5, comprising:

a spring for exerting said restoring force on said locking element.

9. The excess-current protective switch as defined in claim 6, wherein:

said stop surface of said stop nose possesses an inclination for counteracting a force generated by the flow of current through said movable contact element and acting upon said locking element.

10. The excess-current protective switch as defined in the claim 9, wherein:

said locking element is substantially horseshoe-shaped and possesses two of said free leg ends;

said two free leg ends of said locking element being provided with stop surfaces;

said stop surfaces of the free leg ends of said locking element having substantially the same inclination as said stop surface of said stop nose.

11. The excess-current protective switch as defined in claim 1, wherein:

said mounting means comprises a bearing sleeve for displaceably guiding said locking element; and said bearing sleeve being penetrated with clearance by said movable contact element.

12. An excess-current protective switch operative between a cut-on position and a cut-off position, comprising:

a substantially tubular-shaped, sealed switch housing have opposed ends and containing an extinguishing gas under excess pressure;

a cap member carrying a stationary contact element and sealing one end of said switch housing;

a plate;

an expansible bellows closed by said plate and sealing the opposite end of said switch housing;

a movable contact element secured to said plate closing the bellows;

said movable contact element being displaceable in its lengthwise direction and protruding into said switch housing;

a stop member arranged at such movable contact element;

a guide plate arranged in said switch housing;

a substantially U-shaped locking element formed of a soft-magnetic material and mounted at said guide plate;

said locking element being displaceable transversely with respect to said movable contact element and surrounding said movable contact element with clearance;

said locking element having free leg ends;

at least one free leg end of said locking element being provided with a stop; and said stop member bearing at said stop in the cut-on position of the protective switch.

13. The excess-current protective switch as defined in claim 12, further including:

a blast nozzle arranged in the switch housing between said guide plate and said stationary contact element; and said blast nozzle being closed by said movable contact element in the cut-on position of the protective switch.

* * * * *